United States Patent [19]

Holland et al.

[11] Patent Number: 5,049,302

[45] Date of Patent: Sep. 17, 1991

[54] STABLE LIQUID DETERGENT COMPOSITIONS WITH ENCHANCED CLAY SOIL DETERGENCY AND ANTI-REDEPOSITION PROPERTIES

[75] Inventors: Richard J. Holland, Grosse Ile; Ornie K. Bullard, Brownstown; Alicia V. York, Detroit, all of Mich.; Dieter Boeckh, Limburgerhof, Fed. Rep. of Germany; Wolfgang Trieselt, Ludwigshafen, Fed. Rep. of Germany; Paul Diessel, Mutterstadt, Fed. Rep. of Germany; Hans-Ulrich Jaeger, Neustadt-Hambach, Fed. Rep. of Germany

[73] Assignee: BASF Corporation, Parsippany, N.J.

[21] Appl. No.: 254,467

[22] Filed: Oct. 6, 1988

[51] Int. Cl.[5] ..... C11D 1/83; C11D 3/37

[52] U.S. Cl. ..... 252/174.17; 252/174.23; 252/174.24; 252/531; 252/532; 252/538; 252/539; 252/546; 252/547; 252/875; 252/8.8

[58] Field of Search ..... 252/174.17, 174.23, 252/174.24, DIG. 2, DIG. 14, DIG. 15, 531, 532, 538, 539, 546, 547, 8.75, 8.8

[56] References Cited

U.S. PATENT DOCUMENTS 4,532,067 7/1985 Padron et al. ..... 252/174.17
4,566,993 1/1986 Secemski et al. ..... 252/559
4,732,693 3/1988 Hight ..... 252/132
4,746,456 5/1988 Kud et al. ..... 252/174.24
4,846,994 7/1989 Kud et al. ..... 252/174.24

FOREIGN PATENT DOCUMENTS 922457 4/1963 United Kingdom .

*Primary Examiner*—Paul Lieberman
*Assistant Examiner*—Alexander G. Ghyka

[57] ABSTRACT

A stable liquid detergent composition having improved clay soil detergency, clay soil anti-redeposition, oily soil anti-redeposition and soil release properties is disclosed. The detergent composition is comprised of an anionic surfactant, a nonionic surfactant, a hydrotrope, a graft copolymer of polyalkylene oxide and an ester monomer, and a nonionic cellulosic anti-redeposition agent. The graft copolymer is comprised of (a) a polyalkylene oxide based upon an alkylene oxide having from 2 to 4 carbon atoms having a molecular weight of 300 to 100,000 and, (b) at least one vinyl ester derived from a saturated monocarboxylic acid containing 1 to 6 carbon atoms, and/or methyl or ethyl ester of acrylic or methacrylic acid in a weight ratio of (a):(b) of from 1:0.2 to 1:10. The nonionic cellulosic anti-redeposition agent is preferably hydroxypropyl methylcellulose. There is a synergism between the nonionic anti-redeposition agent and the graft polyol which imparts improved clay soil detergency, clay anti-deposition and oily soil anti-redeposition properties to the detergent composition.

20 Claims, No Drawings

STABLE LIQUID DETERGENT COMPOSITIONS WITH ENCHANCED CLAY SOIL DETERGENCY AND ANTI-REDEPOSITION PROPERTIES

BACKGROUND OF THE INVENTION

1. Field of the Invention

The present invention relates to a liquid detergent composition which exhibits enhanced detergency and anti-redeposition properties as well as excellent freeze/thaw and low temperature storage stability.

2. Description of the Related Art

Padron et al, U.S. Pat. No. 4,532,062 disclose aqueous liquid detergent compositions which exhibit good freeze/thaw and low temperature stability. The Padron composition contains hydroxypropyl methylcellulose (HPMC) in a liquid formulation together with builders and anionic and nonionic surfactants. Padron et al. do not include a graft copolymer of polyethylene glycol and a vinyl ester.

Bevin, U.S. Pat. No. 4,020,015 discloses a process whereby a cellulose containing ether linked anti-redeposition agent is combined with a copolymer of polyethylene glycol and polyethylene teraphthalate and the condensation product of polyethylene glycol and adipic acid and caprolactam or hexamethylene diamine or salts of caprolactam or hexamethylene diamine with adipic acid. The copolymer of Bevin is not the graft copolymer of the present invention and no mention is made in Bevin of a synergism between the graft copolymer of the present invention and a nonionic cellulosic anti-redeposition agent (e.g. HPMC).

Dean et al, U.S. Pat. No. 3,523,088 disclose an anti-redeposition agent and built detergent composition for use in washing synthetic fibers, fabrics, synthetic cotton blends, cotton fabrics and mixtures thereof. The anti-redeposition agent is a blend of carboxymethylcellulose and hydroxypropyl methylcellulose. There is no teaching of using a graft copolymer such as disclosed in the present invention to make a liquid detergent composition which exhibits improved anti-redeposition activity and improved low temperature storage stability such are exhibited by the present invention.

SUMMARY OF THE INVENTION

The present invention relates to a clear, homogenous storage stable liquid detergent composition with enhanced detergency, anti-redeposition properties and excellent freeze/thaw and low temperature stability. The composition is comprised of an anionic surfactant, a nonionic surfactant, a hydrotrope, a nonionic cellulosic agent, and a synergistic amount of a graft copolymer comprised of a polyalkylene oxide based upon alkylene oxide having from 2 to 4 carbon atoms, having a number average molecular weight of about 300 to 100,000; and at least one vinyl derivative from the group consisting of a saturated monocarboxylic acid containing 1 to 6 carbon atoms, a methyl or ethyl ester of acrylic or methacrylic acid and mixtures thereof, whereby the ratio of the polyalkylene oxide to the vinyl derivative is from about 1:0.1 to 1:10; and the balance water. The detergent composition exhibits improved particulate soil detergency and particulate soil anti-redeposition performance as well as oily soil anti-redeposition and soil release properties due to a synergism between the graft copolymer and the nonionic cellulosic anti-redeposition agent. In addition, good freeze/thaw and low temperature stability is observed for these compositions.

The present invention further relates to a method for producing a clear homogeneous liquid laundry detergent composition which exhibits good freeze/thaw and low temperature storage stability. The composition is made by sequentially adding the hydrotrope followed by the anionic surfactant to deionized water under moderate agitation and moderate heat. Next a nonionic surfactant is added followed by the nonionic cellulosic anti-redeposition agent. Then under continued moderate agitation the graft copolymer described above is added together with builders and other components such as are known in the art.

DETAILED DESCRIPTION OF THE PREFERRED EMBODIMENT

The present invention relates to a clear, homogeneous liquid laundry detergent composition which includes a synergistic amount of a graft copolymer of a polyalkylene oxide and a vinyl ester such as vinyl acetate, and an anti-redeposition amount of a nonionic cellulosic anti-redeposition agent such as HPMC. The liquid detergents of the present invention are unique in that the graft copolymer significantly boosts clay soil detergency in the presence of the nonionic cellulosic anti-redeposition agents. In addition, there is a substantial improvement in clay soil anti-redeposition, as well as significant oily soil redeposition inhibition and improved soil release performance. Combinations of the graft copolymer and the nonionic cellulose agent are particularly effective in preventing or reducing both particulate and oily soil redeposition on cotton, polyesters and polyester/cotton blend fabrics.

The graft copolymers useful in the detergents of the present invention are known from GB Patent 922,457 incorporated herein by reference. These graft copolymers have a number average molecular weight of about 300 to 100,000 and are based on polyalkylene oxides and an ester. The polyalkylene oxide monomer may be derived from ethylene oxide, propylene oxide, butylene oxide, or mixtures thereof. It is preferred to use homopolymers or ethylene oxide or ethylene oxide copolymers having an ethylene oxide content of from about 40 to 99 mole percent. Suitable comonomers for these copolymers may be selected from the group consisting of propylene oxide, n-butylene oxide, isobutylene oxide, and mixtures thereof. Copolymers of ethylene oxide and propylene oxide or butylene oxide or mixtures of butylene oxide and propylene oxide are most preferred. The ethylene oxide content of the copolymers is from about 40 to 99 mole percent, the propylene oxide content of the copolymer is from about 1 to 60 mole percent, and the butylene oxide content in the copolymer is from about 1 to 30 mole percent.

In addition to straight chain homopolymers and copolymers, those skilled in the art recognize that it is also possible to use branched homopolymers or copolymers as the graft base. Suitable branched copolymers may be prepared by the addition of ethylene oxide, either alone or in combination with propylene oxide, butylene oxide and mixtures thereof, onto polyhydric low molecular weight alcohols. Suitable alcohol initiators may be selected from the group consisting of trimethylolpropane, pentose, hexose, and mixtures thereof. The alkylene oxide unit can be randomly distributed in the polymer or it may be present as blocks of the graft copolymer. Preferably, the polyalkylene oxide is comprised of polyethylene oxides having a number average molecular weight of 1,000 to 50,000.

The esters which are useful comonomers may be selected from vinyl esters which are derived from a saturated monocarboxylic acid containing 3 to 6 carbon atoms, methyl acetate, ethyl acetate, methyl methacrylate, ethyl methacrylate and mixtures thereof. Preferably, the ester comonomer is vinyl acetate. Other vinyl esters may be selected from the group consisting of vinyl propionate, vinyl butyrate, vinyl valerate, vinyl i-valerate and vinyl caproate, vinyl acetate and mixtures thereof. It is preferred to use vinyl propionate, methyl acrylate or mixtures of vinyl propionate with up to 95 percent by weight of vinyl acetate.

The graft copolymers are prepared by grafting the polyalkylene oxide monomer with the vinyl ester monomer in the presence of free radical initiators or by the use of high-energy radiation. The graft copolymers may also be prepared by dissolving the polyalkylene oxide in at least one vinyl ester, in the presence of a polymerization initiator and polymerizing the mixture to completion. The graft copolymer may also be prepared in a semicontinuous manner. Specifically, a 10 percent mixture of the polyalkylene oxide, at least one vinyl ester, and a suitable initiator are heated to the polymerization temperature. After polymerization has begun, the remainder of the mixture to be polymerized is added to the reaction mixture at a rate comensurate with the rate of polymerization. The graft copolymers can also be prepared by introducing the polyalkylene oxide into a reactor, heating the reactor to the polymerization temperature and adding initiator either all at once, or a little at a time or, preferably, at a rate equal to the rate of polymerization.

Organic peroxides are one group of suitable polymerization initiators. These peroxides may be selected from the group consisting of diacetyl peroxide, dibenzoyl peroxide, succinyl peroxide, di-tert-butyl peroxide, tert-butyl perbenzoate, tert-butyl perpivalate, tert-butyl permaleate, cumene hydroperoxide, diisopropyl peroxodicarbamate, bis(o-toluoyl)peroxide, didecanoyl peroxide, dioctanoyl peroxide, dilauroyl peroxide, tert-butyl perisobutyrate, tert-butyl hydroperoxide, and mixtures thereof. Other suitable polymerization initiators include redox initiators and azo-starters.

The graft polymerization takes place at from about 50° to 200° C., and preferably at from about 70° to 140° C. The polymerization is customarily carried out at atmospheric pressure, but those skilled in the art understand that it may also be carried out under reduced or superatmospheric pressure. If desired, the graft copolymerization process may also be carried out in a solvent. Suitable solvents may be alcohols selected from the group consisting of methanol, ethanol, n-propanol, isopropanol, sec-butanol, tert-butanol, n-hexanol, cyclohexanol and mixtures thereof. Glycols may also serve as suitable solvents. Those glycols may be selected from the group consisting of ethylene glycol, propylene glycol, butylene glycol, the methyl or ethyl ether of dihydric alcohols, diethylene glycol, triethylene glycol, glycerol, dioxane and mixtures thereof. The graft polymerization may also be carried out using water as a solvent.

When water is used as the solvent, the vinyl ester is introduced into the water. An organic solvent may be added to transfer any water-insoluble products which may form during polymerization into the solution. Suitable organic solvents may be selected from the group consisting of monohydric alcohols having 1 to 3 carbon atoms, acetone, dimethylformamide, and mixtures thereof. Further, it is also possible in the presence of water, to transfer the graft copolymers onto a finely divided dispersion by adding suitable emulsifiers or protective colloids such as polyvinyl alcohol. Suitable emulsifiers include ionic or nonionic surfactants whose HLB (hydrophilic/lipophilic) value is within the range of about 3 to 13.

The amount of surfactant used is based on the amount of graft polymer. Usually, the amount of surfactant used is from about 0.1 to 5 percent by weight. If water is used as the solvent, solutions or dispersions of graft polymers are obtained. If solutions of graft polymers are prepared in an organic solvent or in mixtures of an organic solvent and water, the amount of organic solvent or solvent mixture used per 100 parts by weight of the graft copolymer is from about 5 to 200, preferably from about 10 to 100 parts by weight.

The weight ratio of the polyalkylene oxide to vinyl ester is from 1:0.2 to 1:10, and preferably from about 1:0.5 to 1:6. Such graft copolymers have a K value of from about 5 to 200, and preferably from about 5 to 70, as determined according to H. Fikentscher in a 2 percent strength by weight solution in dimethylformamide at 25° C. After the graft polymerization is complete, the graft copolymer may be subjected to hydrolysis, where up to about 15 mole percent of the vinyl ester may be hydrolized.

For example, the hydrolysis of graft polymers prepared using vinyl esters results in graft polymers which contain vinyl alcohol units. The hydrolysis may be carried out by adding a base, such as sodium hydroxide solution or potassium hydroxide solution, or alternatively, by adding acids and, if necessary, heating the mixture.

The instant liquid detergent systems are directed at mixed anionic-nonionic surfactant compositions.

Nonionic surfactants can be broadly defined as surface active compounds which do not contain ionic functional groups. An important group of chemicals within this class are those produced by the condensation of alkylene oxide groups (hydrophilic in nature) with an organic hydrophobic compound; the latter is aliphatic or alkyl aromatic in nature. The length of the hydrophilic or polyoxyalkylene radical which is condensed with any particular hydrophobic group can be readily adjusted to yield a water-soluble compound having the desired degree of balance between hydrophilic and hydrophobic elements. Illustrative but not limiting examples of the various chemical types of suitable nonionic surfactants include:

(a) polyoxyethylene or polyoxypropylene condensates of aliphatic carboxylic acids, whether linear- or branched-chain and unsaturated or saturated, containing from about 8 to about 18 carbon atoms in the aliphatic chain and incorporating from 5 to about 50 ethylene oxide or propylene oxide units. Suitable carboxylic acids include "coconut" fatty acids (derived from coconut oil) which contain an average of about 12 carbon atoms, "tallow" fatty acids (derived from tallow-class fats) which contain an average of about 18 carbon atoms, palmitic acid, myristic acid, stearic acid and lauric acid;

(b) polyoxyethylene or polyoxypropylene condensates of aliphatic alcohols, whether linear- or branched-chain and unsaturated or saturated, containing from about 8 to about 24 carbon atoms and incorporating from about 5 to about 50 ethylene oxide or propylene oxide units. Suitable alcohols include the "coconut" fatty alcohol, "tallow" fatty alcohol, lauryl alcohol, myristyl alcohol and oleyl alcohol. Particularly preferred nonionic surfactant compounds in this category are the "Neodol" type products, a registered trademark of the Shell Chemical Company. Neodol 25-7, a $C_{12}$-$C_{15}$ linear primary alcohol ethoxylated with an average of 7 moles ethylene oxide has been found particularly useful;

(c) polyoxyethylene or polyoxypropylene condensates of alkyl phenols, whether linear- or branched-chain and unsaturated or saturated, containing from about 6 to about 12 carbon atoms and incorporating from about 5 to about 25 moles of ethylene oxide or propylene oxide.

Appropriate concentrations for the nonionic surfactant range from about 0.1% to about 15% by weight of the total formulation. Preferably, the concentrations range from about 2% to about 10%.

A wide variety of anionic surfactants may be utilized. Anionic surfactants can be broadly described as surface active compounds with negatively charged functional group(s). An important class within this category are the water-soluble salts, particularly alkali metal salts, of organic sulfur reaction products. In their molecular structure is an alkyl radical containing from about 8 to 22 carbon atoms and a radical selected from the group consisting of sulfonic and sulfuric acid ester radicals. Such surfactants are well known in the detergent art. They are described at length in "Surface Active Agents and Detergents", Vol. II, by Schwartz, Perry & Berch, Interscience Publishers Inc., 1958 herein incorporated by reference.

Particularly suitable anionic surfactants for the instant invention are the higher alkyl mononuclear aromatic sulfonates. They contain from 10 to 16 carbon atoms in the alkyl chain. Alkali metal or ammonium salts of these sulfonates are suitable, although the sodium salts are preferred. Specific examples include: sodium linear tridecyl benzene sulfonate; and sodium p-n-dodecyl benzene sulfonate. These anionic surfactants are present usually from about 5% to about 30% by weight of the total composition. More preferably, they are present from about 15% to about 20%.

The presence of a hydrotrope within the composition is highly desirable. Hydrotropes are substances that increase the solubility in water of another material which is only partially soluble. Preferred hydrotropes are the alkali metal or ammonium salts of benzene sulfonic acid, toluene sulfonic acid and xylene sulfonic acid. Hydrotropes are present from about 1% to about 10% by weight of the total composition.

Those skilled in the art recognize that the detergent compositions described herein may also contain incrustation inhibitors, perfumes, bleaches, corrosion inhibitors, antifoamers, optical brighteners, enzymes and other additives.

Those skilled in the art further understand that any builder suitable for use in a liquid detergent composition may be used in the present invention. Some builders which are contemplated for use include inorganic builders which can be used alone or in combination with themselves and organic alkaline sequestrant builder salts. Examples of these include alkalai metal carbonates, phosphates, polyphosphates, zeolites and silicates. Specific examples of such salts are sodium tripolyphosphate, sodium carbonate, sodium pyrophosphate, potassium pyrophosphate, potassium tripolyphosphate, sodium hexametaphosphate and sodium alumino silicates (zeolites). Examples of organic builder salts which can be used alone or in admixture with each other or with the preceding inorganic alkaline builder salts are alkali metal polycarboxylates, sodium and potassium citrate, sodium and potassium tartarate, sodium and potassium N-(2-hydroxyethyl)-ethylene diamine tetraacetates, sodium and potassium nitrilotriacetates, and sodium and potassium N-(2-hydroxyethyl)-nitrilo diacetates. These builders may be used separately or as mixtures.

The anti-redeposition agents suitable for use in the compositions of the present invention include hydroxyalkyl alkylcellulose and alkylcellulose where the alkyl in each instance has from 1 to 4 carbon atoms. These anti-redeposition agents are derived from cellulose and can be described as cellulose having substituent groups on the hydroxyls of the anhydroglucose units. The basic structure of cellulose which forms the backbone of the anti-soiling agents of the invention may be depicted as follows, wherein n is a finite number.

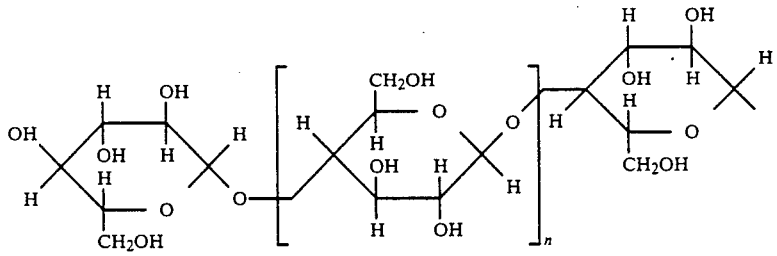

The number of substituent groups of the hydroxyls of the anhydroglucose units of cellulose can affect a number of properties, such as solubility and gel point. Substituent groups can be designated by weight percent or by the number of points where groups are attached to the hydroxyls, otherwise termed "degree of substitution" (D.S.) If all three available positions on each unit are substituted, the D.S. is designated as (3) three; if an average of two on each ring are reacted, the D.S. is designated as (2) two, etc.

In the manufacture of suitable anti-redeposition agents of the invention having methoxy substitution, cellulose fibers, from cotton linters or wood pulp, are swelled by caustic soda solution to product alkali cellulose which is then treated with alkyl chloride, e.g., methyl chloride, yielding the alkyl ether of cellulose, e.g., methyl cellulose. A preferred anti-soiling agent of the invention is a hydroxyalkyl alkylcellulose which is prepared by swelling cotton linters or wood pulp with a caustic soda solution to produce alkali cellulose which is treated with an alkylene oxide, e.g., propylene oxide which leads to a substituent group having a secondary hydroxyl on the number two carbon [$OCH_2CH(OH)CH_2$].

The basic structure for a preferred anti-redeposition agent useful in the present invention, hydroxypropyl methylcellulose, may be shown according to the following formula wherein n is a finite number.

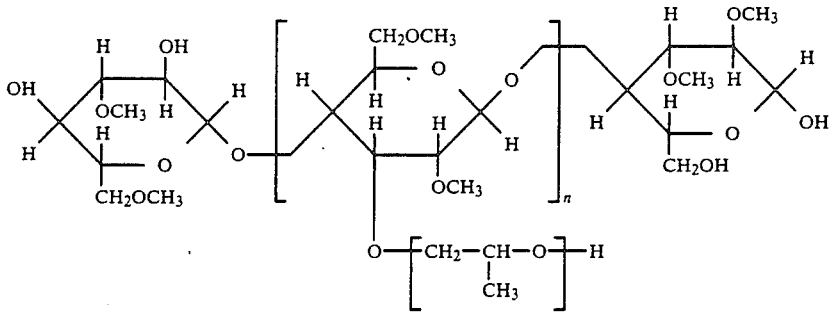

Especially suitable is such a material wherein the methoxy substitution corresponds to from about 27 percent to 30 percent by weight and propylene glycol ether substitution amounts to 7 percent to 12 percent by weight.

Another preferred anti-redeposition agent is methyl cellulose. These preferred materials are commercially available under the name METHOCEL® A (The Dow Chemical Company).

The anti-redeposition agents of the invention are characterized by molecular weights which can be expressed in terms of their viscosity grades measured with a Ubbelohde tube as a 2 percent by weight aqueous solution at 20° C. It will be appreciated that the viscosity that such materials will produce in solution depends on the length of the polymer chain.

The preferred anti-redeposition agents are selected from the group consisting of methylcellulose, ethylcellulose, hydroxyethyl cellulose, hydroxypropyl cellulose, hydroxyethyl methylcellulose, ethylhydroxy ethyl cellulose, hydroxybutyl methylcellulose, hydroxypropyl methylcellulose, and mixtures thereof. The most preferred anti-redeposition agent is hydroxypropyl methylcellulose.

It is critical that in order to formulate a liquid composition which is clear, the addition of the individual components must proceed in a specific order.

Specifically, the method for making the clear homogeneous liquid laundry detergent composition comprises the sequential steps of:

(a) Adding an anionic hydrotrope to deionized water under moderate agitation.

(b) Adding an anionic surfactant to the mixture of water and hydrotrope under moderate agitation and heating until a clear liquid is obtained.

(c) Adding a nonionic surfactant to the mixture with moderate agitation and heating until a clear liquid is obtained;

(d) Adding a synergistic amount of a graft copolymer comprised of a polyalkylene oxide having from 2 to 4 carbon atoms having a number average molecular weight of about 300 to 100,000; and at least one vinyl derivative from the group consisting of a saturated monocarboxylic acid containing 1 to 6 carbons, a methyl or ethyl ester of acrylic or methacrylic acid and mixtures thereof, whereby the ratio of the polyalkylene oxide and the vinyl derivative is from about 1:0.2 to 1:10. The graft copolymer is added under moderate agitation and heating until the liquid is clear;

(e) adding an anti-redeposition amount of a nonionic cellulosic anti-redeposition agent under moderate agitation and heating until the composition is clear, and (f) optionally adding a builder, whereby a built clear, homogeneous liquid detergent composition is formed which exhibits good freeze/thaw properties and extended storage stability.

It is also contemplated that various additives which are known in the art, may be added to the liquid composition.

It is an object of this invention to improve the oily soil anti-redeposition properties of liquid detergent compositions. It is also an object of this invention to improve the soil release properties of these formulations. It is a further object of this invention to improve the clay soil detergency and anti-redeposition properties of these compositions.

It has been observed that by combining nonionic cellulose ethers with the graft copolymer overall detergency, soil release and anti-redeposition performance are significantly improved with both particulate and oily soils. These performance features cannot be obtained by the nonionic cellulose ether or the graft copolymer alone, nor can they be achieved with blends of nonionic cellulose ethers and anionic cellulose ethers (carboxymethyl cellulose).

The following examples are presented to illustrate various aspects of the invention. Those skilled in the art understand they are not to be construed as limiting the scope or spirit of the invention.

EXAMPLE I

STABILITY STUDIES

Various heavy duty liquid detergent formulations described in Table I were tested for freeze/thaw stability (i.e. maintaining clarity without phase separation or precipitation). This evaluation was carried out by alternately subjecting the samples to −50° F. for 24 hours followed by warming to 70° F. for 24 hours. This procedure was employed except during weekends when sample temperature was maintained at 70° F. for forty eight hours. The formulations were exposed to these temperature extremes for a total of six cycles. The compositions were inspected following each cycle. Observations of sample clarity, phase separation and precipitation were noted as seen in Table II. Notice that formulations A and C are stable through six freeze/thaw cycles. Formula B exhibits only a slight amount of precipitation under these circumstances.

TABLE I

| COMPONENTS | FORMULA A WEIGHT % | FORMULA B WEIGHT % | FORMULA C WEIGHT % |
|---|---|---|---|
| SODIUM ALKYLBENZENE SULFONATE | 16.0 | 16.0 | 16.0 |
| ETHOXYLATED ALCOHOL (7EO) | 7.0 | 7.0 | 7.0 |
| SODIUM CITRATE | — | — | 7.0 |
| SODIUM XYLENE SULFONATE | 6.0 | 6.0 | 6.0 |
| GRAFT COPOLYMER | 0.5 | 0.8 | 0.8 |
| HPMC | 0.1 | 0.3 | — |
| WATER | TO 100 | TO 100 | TO 100 |

TABLE II

| FORMULATION | CYCLE/OBSERVATIONS 1ST | 3RD | 6TH |
|---|---|---|---|
| A | CLEAR/ HOMOGEN | CLEAR/ HOMOGEN | CLEAR/ HOMOGEN |
| B | SLIGHT PPT | SLIGHT PPT | SLIGHT PPT |
| C | CLEAR/ HOMOGEN | CLEAR/ HOMOGEN | CLEAR/ HOMOGEN |

EXAMPLE II

CLAY SOIL DETERGENCY

The soil removal performance of liquid detergent composition D shown in Table III was evaluated using a ten minute wash cycle at 100° F. and 150 ppm water hardness. Ground in clay soiled swatches were used (Scientific Services) including three fabric types: cotton (S-405); polyester (S-767) and D(65)/C(35) blend (S-7435). Soil removal was determined by measuring the change in reflectance between the soiled and cleaned swatch. A Gardner colorimeter was employed to monitor reflectance. All components in the formulations were kept constant except for the anti-redeposition agent. Percentages of these additives are by weight.

Table IV, depicts the detergency performance of variations of formula D a reported in Table 1 with different combinations of anti-redeposition agents. Least significant differences at the 95% confidence level are shown in parenthesis. As is shown below, the clay detergency performance of the built liquid detergent containing the graft copolymer and HPMC was significantly improved over HPMC alone. This performance boost occured on all fabrics used in the assessment: clay/cotton (4.6 Rd unit increase); clay/polyester (6.8 Rd unit increase) and clay/blend (5.4 unit increase). Over the three fabrics tested, a total improvement of 16.8 Rd units was noted. In contrast, the combination of CMC and HPMC showed no performance advantage on any of the three fabrics evaluated.

TABLE III

| | FORMULA D WEIGHT % |
|---|---|
| Sodium Alkyl benzene Sulfonate | 16.0 |
| Ethoxylated Alcohol (7EO) | 7.0 |
| Sodium Citrate | 7.0 |
| Sodium Xylene Sulfonate | 7.0 |
| Graft Copolymer | AS NOTED |
| HPMC | AS NOTED |

TABLE III-continued

| | FORMULA D WEIGHT % |
|---|---|
| Water | TO 100 |

TABLE IV

CLAY SOIL DETERGENCY OF FORMULA D UNITS (CHANGE IN REFLECTANCE)

| PERCENT ADDITIVE | | COTTON | POLY | D(65)/C(35) |
|---|---|---|---|---|
| Graft Copolymer | 1.65% | 16.5 (1.0) | 30.0 (1.1) | 29.9 (0.9) |
| Graft Copolymer | 1.65% | 12.8 (1.5) | 20.1 (0.8) | 28.6 (1.7) |
| HPMC | 1.00% | | | |
| CMC | 1.65% | 8.4 (0.8) | 12.4 (1.3) | 25.5 (1.1) |
| HPMC | 1.00% | | | |
| HPMC | 1.00% | 8.2 (1.4) | 13.3 (0.8) | 24.0 (1.4) |

EXAMPLE III

CLAY SOIL ANTI-REDEPOSITION PROPERTIES

The anti-redeposition performance of formula D (and variants thereof) was monitored using a three cycle clay soil deposition test. Each 10 minute Terg-o-tometer wash cycle was carried out at 100° F. and 150 ppm hardness. Nine clay/cotton cloths (Scientific Services) and 300 milligrams of bandy black clay were used as the source of the soil. Three clean cotton cloths (S-405; Testfabrics) and three clean D(65)/C(35) blend cloths (S-7435) were also included to measure redeposition. The loss in whiteness of these fabrics as monitored by their change in reflectance after the third wash cycle was taken as a measure of the amount of soil redeposited on the fabric. Additionally, the detergency value (change in reflectance) for the soiled cotton cloth was evaluated. Confidence intervals (95% level) are again shown in parenthesis.

The clay redeposition results are shown in Table V below. As with the detergency results above, the addition of the graft copolymer to HPMC significantly improved the clay soil anti-redeposition performance of the built liquid composition relative to the formula containing only HPMC. The clay detergency performance shown in Table V for the graft copolymer /HPMC blend was also significantly improved over HPMC alone. Finally, the addition of CMC to HPMC provided no advantage with regard to anti-redeposition performance on D(65)/C(35) blend with only slight improvement on cotton. Clay detergency was, again, greatly reduced with formulations containing a mixture of CMC and HPMC.

TABLE V

CLAY SOIL ANTI-REDEPOSITION OF FORMULA D

| Formulation | Loss in Whiteness (Rd Units) COTTON | D(65)/C(35) BLEND | Detergency (Rd Units) CLAY/ COTTON |
|---|---|---|---|
| NO ADDITIVE | 2.1 (0.42) | 1.7 (0.18) | 20.0 (0.90) |
| GRAFT COPOLYMER 1.65% | 1.9 (0.27) | 1.3 (0.20) | 21.0 (0.43) |
| GRAFT COPOLYMER 1.65% HPMC 1% | 3.7 (0.39) | 2.5 (0.19) | 14.9 (0.95) |
| CMC 1.65% HPMC 1.0% | 5.1 (0.79) | 3.5 (0.11) | 9.5 (0.63) |

TABLE V-continued

| CLAY SOIL ANTI-REDEPOSITION OF FORMULA D | | | |
|---|---|---|---|
| | Loss in Whiteness (Rd Units) | | Detergency (Rd Units) |
| Formulation | COTTON | D(65)/C(35) BLEND | CLAY/ COTTON |
| HPMC 1.0% | 6.8 (0.75) | 3.7 (0.14) | 9.2 (0.32) |

EXAMPLE IV

SEBUM REDEPOSITION STUDIES

Studies were also carried out with an oily soil (Spangler sebum). The same methodology employed in the clay redeposition experiments was also used in the sebum redeposition investigations. However, nine sebum soiled cotton swatches (Scientific Services) and a 400 milligram sebum spike were used as the source of the soil. Three clean polyester (Testfabrics S-767) and three clean D(65)/C(35) blend fabrics (Testfabrics S-7435) were included to monitor redeposition.

As shown in Table VI, a number of improvements in detergency and anti-redeposition performance were obtained by blending the graft copolymer with HPMC. First, better sebum soil removal (cotton fabric) was observed with the HPMC/graft polyol combination relative to the unaided formula. The graft copolymer plus HPMC substantially improved sebum anti-redeposition performance on polyester fabric compared to HPMC alone. Note that blends of CMC and HPMC showed no performance improvements. These advantages were in addition to the improvements in clay soil removal and clay soil anti-redeposition obtained with blends of HPMC and the graft copolymer noted in Tables IV and V.

TABLE VI

| SEBUM REDEPOSITION OF FORMULA A | | | |
|---|---|---|---|
| | Loss in Whiteness (Rd units) | | Detergency (Rd units) |
| FORMULATION | POLYESTER | D(65)/C(35) BLEND | SEBUM/ COTTON |
| NO ADDITIVE | 8.2 (0.3) | 2.8 (0.1) | 9.9 (0.9) |
| graft copolymer 1.0% | 6.0 (0.5) | 1.3 (0.1) | 11.3 (1.0) |
| graft copolymer 2.0% | 0.7 (0.1) | 0.7 (0.1) | 11.9 (0.5) |
| HPMC 1.0% CMC 2.0% | 2.6 (0.2) | 0.8 (0.1) | 11.7 (0.9) |
| HPMC 1.0% HPMC 1.0% | 2.4 (0.3) | 0.7 (0.1) | 10.9 (0.8) |
| CMC 1.0% | 8.7 (0.6) | 2.6 (0.1) | 10.7 (0.8) |

EXAMPLE V

DIRTY MOTOR OIL SOIL RELEASE

Two fabric types were evaluated for dirty motor oil soil release: dacron single knit polyester (S-730 Test fabrics) and D(65)/C(35) blend (S-7435 Testfabrics). Five replicates of each fabric were prewashed (ten minutes) in variations of formula D at 120° F. and 150 ppm water hardness and rinsed for five minutes. After one cycle the fabrics were dried in a Whirlpool Imperial clothes dryer for thirty minutes on the high setting. Three drops of dirty motor oil (obtained from a 1975 Ford Granada) were added to each swatch and the stain was allowed to wick overnight.

Reflectance readings were taken with a Gardner colorimeter for each stained fabric (Rd2). The swatches were washed in the citrate/LAS/NI/SXS composition (formula D) at 120° F. and 150 ppm water hardness for ten minutes followed by a five minute rinse. After drying the reflectance values of the washed swatches (Rd3) were measured. Standard clean swatches were used to determine an initial reflectance value (Rd1) for both fabric types. Percent soil release (% SR) was calculated using these three reflectance values (Rd1, Rd2, and Rd3) as follows:

$$\{Rd3 - Rd2) / (Rd1 - Rd2) \times 100 = \% \text{ SR}$$

where

Rd1 = the reflectance of the virgin fabric

Rd2 = the reflectance of the stained fabric

Rd3 = the reflectance of the washed fabric

Results shown in Table VII (95% confidence intervals are in parenthesis) show that the graft copolymer exhibited little benefit in dirty motor oil soil release when used in formula D. The combination of HPMC with the graft polyol provided good dirty motor oil soil release from polyester and some performance on the polyester/cotton blend.

TABLE VII

| DIRTY MOTOR OIL SOIL RELEASE PROPERTIES (FORMULA A) | | |
|---|---|---|
| | FABRIC TYPE | |
| PERCENT ADDITIVE | SINGLE KNIT POLY. (S-730) | D(65)/C(35) (S-7435) |
| NO ADDITIVE | 0.0% | 9.0% (1.1%) |
| graft copolymer 2.0% | 0.0% | 10.8% (0.5%) |
| HPMC 1.0% | 64.9% (2.4%) | 37.7% (5.5%) |
| graft copolymer 2.0% HPMC 1.0% | 67.7% (2.3%) | 39.3% (3.7%) |

The embodiments of the invention in which an exclusive privilege or property is claimed are defined as follows:

1. A clear, homogeneous liquid laundry detergent composition, which exhibits good freeze/thaw and low temperature storage stability, comprising:

(a) an anionic surfactant;

(b) an anionic hydrotrope;

(c) an anti-redeposition amount of a nonionic cellulosic agent;

(d) a nonionic surfactant;

(e) a a graft copolymer resulting from the copolymerization of;

(i) a polyalkylene oxide based upon alkylene oxides having from 2 to 4 carbon atoms having a number average molecular weight of about 300 to 100,000; and (ii) at least one ethylenically unsaturated compound selected from the group consisting of a vinyl ester of a saturated monocarboxylic acid containing 1 to 6 carbon atoms, a methyl or ethyl ester of acrylic or methacrylic acid and mixtures thereof, whereby the ratio of (i);(ii) is from about 1:0.2 to 1:10; and (f) the balance water, wherein said detergent composition exhibits improved particulate soil detergency, particulate soil anti-redeposition, and oily soil anti-redeposition and soil release properties due to a synergism between the graft copolymer and the nonionic cellulosic anti-redeposition agent.

2. The composition of claim 1, wherein said nonionic cellulosic anti-redeposition agent is selected from the group consisting of methylcellulose, ethylcellulose, hydroxyethyl cellulose, hydroxypropyl cellulose, hydroxy ethyl methylcellulose, ethyl hydroxyethyl cellulose, hydroxybutyl methylcellulose, hydroxypropyl methylcellulose and mixtures thereof.

3. The composition of claim 1, wherein said ethylenically unsaturated compound is hydrolyzed up to about 15 mole percent.

4. The composition of claim 1, wherein said graft copolymers are comprised of polyethylene oxide and vinyl acetate.

5. The composition of claim 1, wherein said ethylenically unsaturated compound is selected from the group consisting of vinyl propionate, vinyl butyrate, vinyl valerate, vinyl i-valerate, vinyl acetate and mixtures thereof.

6. The composition of claim 1 wherein said ethylenically unsaturated compound is a mixture of vinyl propionate, methyl acrylate or mixtures of vinyl propionate with up to 95 percent by weight vinyl acetate.

7. The composition of claim 1, wherein said anionic surfactant is selected from the group consisting of $C_8$ to $C_{14}$ alkylbenzene sulfonates, $C_{12}$ to $C_{16}$ alkylsulfates, $C_{12}$ to $C_{16}$ alkylsulfosuccinates, sulfated ethyoxylated $C_{12}$ to $C_{16}$ alkanols, and mixtures thereof.

8. The composition of claim 1, wherein said hydrotrope is selected from the group consisting of alkali metal salts of benzene sulfonic acid, toluene sulfonic acid, xylene sulfonic acid, ammonium salts of benzene sulfonic acid, toluene sulfonic acid, xylene sulfonic acid, and mixtures thereof.

9. The composition of claim 1, wherein the anionic surfactant is present in a amount of from about 10 to 60 weight percent, the nonionic cellulosic anti-redeposition agent is present in an amount of 0.1 to 5 weight percent, the hydrotrope is present in an amount of about 1 to 10 weight percent and the graft copolymer is present in an amount of from about 0.1 to 10 weight percent.

10. The composition of claim 1, wherein said nonionic surfactant is selected from the group consisting of:

(a) polyoxyethylene or polyoxypropylene condensates of aliphatic carboxylic acids, whether linear- or branched-chain and unsaturated or saturated, containing from about 8 to about 18 carbon atoms in the aliphatic chain and incorporating from 5 to about 50 ethylene oxide or propylene oxide units, coconut fatty acids (derived from coconut oil) which contain an average of about 12 carbon atoms, "tallow" fatty acids (derived from tallow-class fats) which contain an average of about 18 carbon atoms, palmitic acid, myristic acid, stearic acid and lauric acid;

(b) polyoxyethylene or polyoxypropylene condensates of aliphatic alcohols, whether linear- or branched-chain and unsaturated or saturated, containing from about 8 to about 24 carbon atoms and incorporating from about 5 to about 50 ethylene oxide or propylene oxide units, coconut fatty alcohol, "tallow" fatty alcohol, lauryl alcohol, myristyl alcohol and oleyl alcohol, $C_{12}$–$C_{15}$ linear primary alcohols ethoxylated with an average of 7 moles ethylene oxide;

(c) polyoxyethylene or polyoxypropylene condensates of alkyl phenols, whether linear- or branched-chain and unsaturated or saturated, containing from about 6 to about 12 carbon atoms and incorporating from about 5 to about 25 moles of ethylene oxide or propylene oxide, and mixtures thereof.

11. A method for making a clear, homogeneous liquid laundry detergent composition having good freeze/-thaw properties and low temperature stability, comprising the sequential steps of:

(a) adding an anionic hydrotrope to deionized water under moderate agitation;

(b) adding an anionic surfactant to the mixture of water and hydrotrope under moderate agitation and heating until a clear liquid is obtained;

(c) adding a nonionic surfactant to the mixture with moderate agitation and heating until a clear liquid is obtained;

(d) adding a graft copolymer comprised of a polyalkylene oxide having from 2 to 4 carbon atoms having a number average molecular weight of about 300 to 100,000; and at least one ethylenically unsaturated compounds selected from the group consisting of a vinyl ester of a saturated monocarboxylic acid containing 1 to 6 carbons, a methyl or ethyl ester of acrylic or methacrylic acid and mixtures thereof, whereby the ratio of the polyalkylene oxide and the vinyl derivative is from about 1:0.2 to 1:10; said graft copolymer added under moderate agitation and heating until the liquid is clear; and (e) adding an anti-redeposition amount of a nonionic cellulosic anti-redeposition agent under moderate agitation and heating until the composition is clear.

12. The method of claim 11, wherein said nonionic cellulosic anti-redeposition agent is selected from the group consisting of methylcellulose, ethylcellulose, hydroxyethyl cellulose, hydroxypropyl cellulose, hydroxy ethyl methylcellulose, ethyl hydroxyethyl cellulose, hydroxybutyl methylcellulose, hydroxypropyl methylcellulose and mixtures thereof.

13. The method of claim 11, wherein said vinyl derivative is hydrolyzed up to about 15 mole percent.

14. The method of claim 11, wherein said graft copolymers are comprised of polyethylene oxide and vinyl acetate.

15. The method of claim 11, wherein said ethylenically unsaturated compound is a mixture of vinyl propionate, vinyl butyrate, vinyl valerate, vinyl i-valerate, vinyl acetate and mixtures thereof.

16. The method of claim 11, wherein said ethylenically unsaturated compound is a mixture of vinyl propionate, methyl acrylate or mixtures of vinyl propionate with up to 95 percent by weight vinyl acetate.

17. The method of claim 11, wherein said anionic surfactant is selected from the group consisting of $C_8$ to $C_{14}$ alkylbenzene sulfonates, $C_{12}$ to $C_{16}$ alkylsulfates, $C_{12}$ to $C_{16}$ alkylsulfosuccinates, sulfated ethyoxylated $C_{12}$ to $C_{16}$ alkanols, and mixtures thereof.

18. The method of claim 11, wherein said hydrotrope is selected from the group consisting of alkali metal salts of benzene sulfonic acid, toluene sulfonic acid, xylene sulfonic acid, ammonium salts of benzene sulfonic acid, toluene sulfonic acid, xylene sulfonic acid, and mixtures thereof.

19. The method of claim 11, wherein said nonionic surfactant is selected from the group consisting of:

(a) polyoxyethylene or poloxypropylene condensates of aliphatic carboxylic acids, whether linear- or branched-chain and unsaturated or saturated, containing from about 8 to about 18 carbon atoms in the aliphatic chain and incorporating from 5 to about 50 ethylene oxide or propylene oxide units, coconut fatty acids (derived from coconut oil) which contain an average of about 12 carbon atoms, "tallow" fatty acids (derived from tallow-class fats) which contain an average of about 18 carbon atoms, palmitic acid, myristic acid, stearic acid and lauric acid;

(b) polyoxyethylene or polyoxypropylene condensates of aliphatic alcohols, whether linear- or branched-chain and unsaturated or saturated, containing from about 8 to about 24 carbon atoms and incorporating from about 5 to about 50 ethylene oxide or propylene oxide units. Suitable alcohols include the coconut fatty alcohol, tallow fatty alcohol, lauryl alcohol, myristyl alcohol and oleyl alcohol, $C_{12}$–$C_{15}$ linear primary alcohols ethoxylated with an average of 7 moles ethylene oxide;

(c) polyoxyethylene or polyoxypropylene condensates of alkyl phenols, whether linear- or branched-chain and unsaturated or saturated, containing from about 6 to about 12 carbon atoms and incorporating from about 5 to about 25 moles of ethylene oxide or propylene oxide, and mixtures thereof.

20. The method of claim 11, wherein the anionic surfactant is present in an amount of from about 10 to 60 weight percent, the nonionic cellulosic anti-redeposition agent is present in an amount of 0.1 to 5 weight percent, and the graft copolymer is present in an amount of from about 0.1 to 10 weight percent.

* * * * *